US005197656A

United States Patent [19]

Hoell et al.

[11] Patent Number: 5,197,656

[45] Date of Patent: Mar. 30, 1993

[54] SLEEVE STYLE CARTON

[75] Inventors: Norbert Hoell, Southgate, Ky.; Charles A. Miller, Williamsburg, Ohio

[73] Assignee: The C.W. Zumbiel Co., Cincinnati, Ohio

[21] Appl. No.: 754,649

[22] Filed: Sep. 4, 1991

[51] Int. Cl.[5] ..... B65D 5/42; B65D 65/22

[52] U.S. Cl. ..... 229/40; 206/199; 206/427

[58] Field of Search ..... 229/40; 206/140, 141, 206/199, 427

[56] References Cited

U.S. PATENT DOCUMENTS

| | | | |
|---|---|---|---|
| D. 237,144 | 10/1975 | Graser . | |
| D. 257,718 | 12/1980 | Dutcher . | |
| D. 262,441 | 12/1981 | Hines . | |
| D. 263,204 | 3/1982 | Dutcher . | |
| D. 280,491 | 9/1985 | Nielsen . | |
| D. 284,552 | 7/1986 | Weaver . | |
| D. 289,262 | 4/1987 | Goetz et al. . | |
| D. 289,263 | 4/1987 | Rusnock et al. . | |
| D. 305,101 | 12/1989 | Winterling . | |
| D. 306,182 | 2/1990 | Ukisu . | |
| D. 308,341 | 6/1990 | Winterling . | |
| D. 308,827 | 6/1990 | Strom et al. . | |
| D. 309,107 | 7/1990 | Winterling . | |
| 2,751,075 | 6/1956 | Arneson | 229/40 |
| 2,795,368 | 6/1957 | Currie | 206/427 |
| 2,987,176 | 6/1961 | Ringler | 229/40 |
| 3,372,800 | 3/1968 | Arneson | 229/40 |
| 3,807,624 | 4/1974 | Funkhouser . | |
| 3,894,681 | 7/1975 | Arneson et al. . | |
| 4,032,053 | 6/1977 | Wilson . | |
| 4,049,189 | 9/1977 | Wood | 229/40 |
| 4,200,220 | 4/1980 | Ganz . | |
| 4,245,772 | 1/1981 | Johnson . | |
| 4,378,879 | 4/1983 | Killy . | |
| 4,396,143 | 8/1983 | Killy . | |
| 4,405,078 | 9/1983 | Dutcher et al. . | |
| 4,478,334 | 10/1984 | Graser . | |
| 4,482,090 | 11/1984 | Milliens . | |
| 4,508,258 | 4/1985 | Graser . | |
| 4,523,676 | 6/1985 | Barrash . | |
| 4,530,461 | 7/1985 | Adamek . | |
| 4,546,914 | 10/1985 | Roccaforte . | |
| 4,679,726 | 7/1987 | Oliff . | |
| 4,706,876 | 11/1987 | Wilson . | |
| 4,735,315 | 4/1988 | Oliff et al. . | |
| 4,802,583 | 2/1989 | Calvert et al. . | |
| 4,838,430 | 6/1989 | Beeman et al. . | |
| 4,919,266 | 4/1990 | McIntosh et al. . | |
| 5,000,313 | 3/1991 | Oliff . | |

*Primary Examiner*—Gary E. Elkins
*Attorney, Agent, or Firm*—Wood, Herron & Evans

[57] ABSTRACT

A sleeve style closed end carton for a can matrix where the cans preferably are the type having necked in head and heel rims. The carton includes corner flaps that are wrapped around the corner cans of the matrix, the corner flaps, along with the top and bottom side wall corners, preferably being structured to make the tapered portion of each corner can's head and heel partially visible when the carton is viewed in top and bottom views, as well as side elevation view, thereby in effect eliminating the carton's corners.

50 Claims, 4 Drawing Sheets

SLEEVE STYLE CARTON

This invention relates to cartons. More particularly, this invention relates to sleeve style can cartons.

Cartons are widely used in the beverage industry in the marketing of its products, e.g., beer and soft drinks. Such products are commonly marketed in cans enclosed within a carton that is sealed with flaps at its ends, the cans being oriented within the carton in a can matrix configuration. The closed end cartons often used in the marketplace today have squared off ends.

There are two basic problems associated with these prior art closed end can cartons which applicant's invention is intended to overcome. First, applicant's carton eliminates the sharp squared off corners of the prior art can cartons. This minimizes distortion or disfigurement of the package during handling from the soft drink bottler through the distribution channels to the retail consumer in that no crumpling of the package at the corners can occur because the sharp package corners are eliminated. And further, elimination of the corners minimizes prospective hand injury to those handling the cartons through the distribution channels, as well as to the retail consumer, because there are no sharp box corners to the cartons. Second, the cans tend to jostle or move within the package after being placed in the carton and the carton ends sealed in the prior art can cartons with the box corner. This for the reason that sufficient clearance must be provided in the carton relative to the can matrix so that the cans can be easily loaded in the carton itself by the canner. And this clearance allows jostling or knocking of the cans against one another within the package as the package is handled through its distribution channels to the retail consumer.

Accordingly, it has been one objective of this invention to provide an improved sleeve style closed end carton for a can matrix where the carton has no sharp box corners, and which instead exposes the rounded head and heel portions of the package's corner cans to the eye and hand of the handler so as to eliminate package distortion or disfigurement at the corners, and so as to minimize hand injury to the package's handler.

It has been another objective of this invention to provide an improved sleeve style closed end carton for a can matrix where the can matrix is tightly wrapped about the circumference of that matrix so that jostling or movement of the cans within the package is minimized, if not indeed eliminated, as the package is handled throughout the distribution channel chain from the canner to the retail consumer.

In accord with these objectives, this invention contemplates a sleeve style closed end carton for a can matrix where the corner cans of the matrix are each of the type having a head, a body, and a heel, each corner can's head and heel having a rim of an outside diameter less than the outside diameter of the body, and each corner can's head and heel including a tapered portion by which the head and heel rims, respectively, are connected with the corner can's body. The sleeve style closed end carton includes top, bottom and opposed side walls foldably connected one to the other so as to form a sleeve open at both ends prior to loading of the carton with the can matrix. The carton includes curved corner structure defined by each of the top and bottom walls with those corners being configured proximately to overlie but not extend substantially beyond a corner can's head and heel rims, respectively. This allows the tapered portion of each corner can's head and heel to be partially visible when the carton is filled with the can matrix and is viewed in top plan view and bottom plan view, respectively. The sleeve style closed end carton also includes a corner flap formed integral with each side wall at each end thereof. Each corner flap is wrapped around a corner can after the can matrix is loaded within the open ended sleeve carton. Each corner flap has a top edge spaced from the top wall so as to define an upper gap between the corner flap and the top wall, and also includes a bottom edge spaced from the bottom wall so as to define a lower gap between the corner flap and the bottom wall. This allows the tapered portions of each corner can's heel and head to be partially visible when the carton is filled with the can matrix and is viewed in side or end elevation view. Top and bottom end panels are foldably connected to opposed ends of the top and bottom walls, respectively. Preferably both the top and bottom end panels are connected, e.g., glued, to the corner flaps at each end of the carton, as well as are connected, e.g., glued with each other, to effect closure of the carton. Preferably the length of the top wall is about equal to but no less than the length of the can line of the can matrix as measured from the outside edge to the outside edge of the can head rims of those cans at opposite ends of the can line when all adjacent cans of the matrix are in body contact one with the other within the carton. Also preferably the length of the bottom wall is about equal to but no less than the length of the can line of the can matrix measured from outside edge to outside edge of the can heel rims of those cans at opposite ends of the can line when all adjacent cans of the matrix are in body contact one with the other within the carton. This allows the carton's corner flaps to be tightly wrapped around the corner cans in the can matrix, and allows the carton's end flaps to be tightly drawn down over the end can rows of the can matrix, thereby establishing a package can matrix where the cans are tightly held in packaged assembly one with the other.

Other objectives of the invention will be more apparent from the following detailed description taken in conjunction with the drawings in which.

Figure 2:
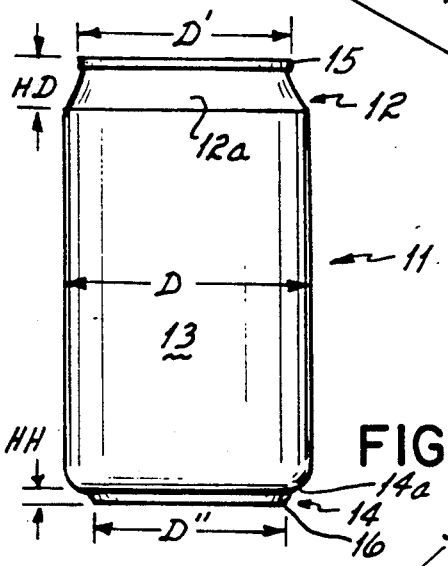
FIG. 2 is a side view of a can used in the type of carton FIG. 1.

The sleeve style closed can carton 10 of this invention is particularly structured for use with soft drink or beer cans 11 of the type illustrated in FIG. 2. Note particularly this can 11 is of the type having a head portion 12, a body portion 13 and a heel portion 14. The can 11 has an outside body diameter D which is greater than the outside head rim diameter D' and also is greater than the outside heel rim diameter D''. Accordingly, the can's head 12 includes a tapered portion 12*a* by which head rim 15 is connected with the can's body 13, and the can's heel 14 also includes a tapered portion 14*a* by which heel rim 16 is connected with the can's body 13. In the embodiment shown, the can's heel rim diameter D'' is slightly less than the can's head rim D', but it is understood that diameter relationship could be reversed or could be the same depending on the can 11 structure used with the carton 10. Further, and in the can 11 embodiment shown, note that the height HD of the can head 12 is twice as great as the height HH of the can heel 14. Again, and in practice, the can head 12 and heel 14 heights HD and HH can be approximately the same and/or reversed relative to the can 11 height relationship shown in FIG. 2.

Figure 5:
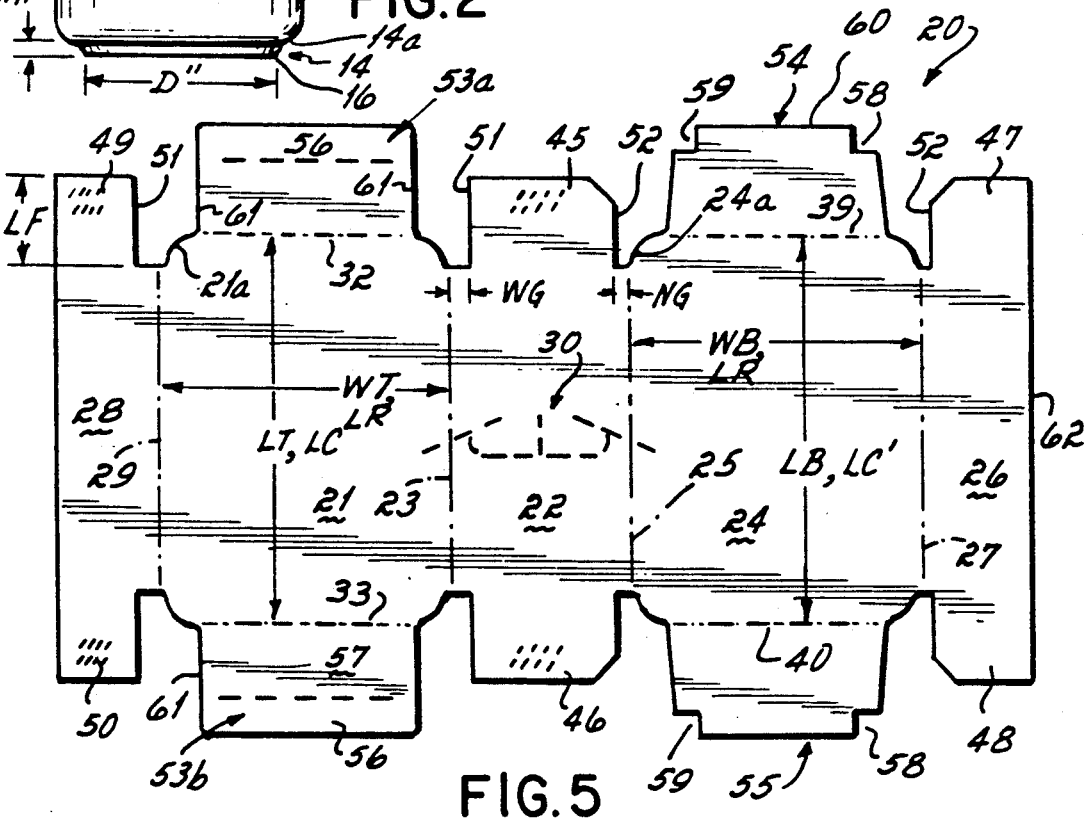
FIG. 5 is a top plan view of a carton blank for the sleeve style closed end can carton in accord with the principles of this invention.

A sleeve style closed end carton blank 20 in accord with the principles of this invention is illustrated in FIG. 5. As shown there, the carton blank 20 is comprised of a top wall panel 21 having a full side wall panel 22 connected on fold line 23 to one side edge thereof. A bottom wall panel 24 is connected along one side edge by fold line 25 to the other edge of the full side wall panel 22. A first partial side wall panel 26 is connected on fold line 27 to the bottom wall panel 24, and a second partial side wall panel 28 is connected along fold line 29 to the other edge of the top wall panel 21. The full side wall panel 22 includes a handle system 30 which forms no part of this invention. A detailed disclosure of that handle system is to be found in U.S. Pat. No. 4,784,316, assigned to the assignee of this invention, the detailed description of same being incorporated herein by reference.

Note particularly the length LT and width WT dimensions of the top wall 21, and the length LB and width WB dimensions of the bottom wall 24, relative to the cans 11 of the can matrix 31 when that can matrix is assembled in packaged relation with the carton blank 20 after it has been glued together into the sleeve style closed end carton package 10. Specifically, and as shown in FIG. 3, note the top end panel's fold lines 32, 33 are proximately oriented to overlie top view tangent lines 34, 35, respectively, drawn along the outer edges of all can's head rims 15 in end can rows 36, 37, respectively, of the can matrix 31. In this regard, the length LT of the top wall 21 is about equal to but no less than the length LC of a can line 38 of the can matrix 31 measured from the outside edge to the outside edge of the can head rims 15 of those cans 11*a*, 11*b* at opposite ends of the can line 38 when all the adjacent cans 11 of the matrix are in body 13 contact one with the other. Further, the bottom wall's fold lines 39, 40 are proximately oriented to overlie bottom view tangent lines 41, 42, respectively, drawn along the outer edges of all cans, heel rims 16 in end can rows 36, 37, respectively, of the can matrix 31. More specifically, the length LB of the bottom wall 24 is about equal to but no less than the length LC' of a can line 38 of the can matrix 31 measured from the outside edge to the outside edge of the can heel rims 16 of those cans at opposite ends of the can line 38 when all adjacent cans 11 of the matrix are in body 13 contact one with the other. When the head rim 15 diameters D' of the cans 11 are greater than or less than the heel rim 16 diameters D'' of the cans, then the length LT, LB of the top 21 and bottom 24 walls may be set at an average of (1) the length LC of a can line 38 of the can matrix 31 measured from the outside edge to outside edge of the can head rims 15, and (b) the length LC' of a can line 38 of the can matrix measured from the outside edge to the outside edge of the can heel rims 16. This averaging technique, if used, means that only a single length LT, LB is used for both the top wall panel 21 and the bottom wall panel 24 of the carton blank. And indeed the averaging technique is used in the FIG. 5 carton blank illustrated since the can head rim 15 is of an outside diameter D' slightly greater than the outside diameter D'' of the can heel rim 16. In any event, the length LT, LB of each of the top 21 and bottom 24 walls, respectively, is not as great as the length of a can line 38 of the can matrix 31 measured from outside face to outside face of the can bodies 13 of those cans 11*a*, 11*b* at opposite ends of the can line when all adjacent cans of that can line are in body contact one with the other. It is this length LT/LC and LB/LC' relationship of the top wall panel 21 and the bottom wall panel 24 relative to the can matrix 31 when the can matrix is installed within a carton erected into the sleeve configuration (as illustrated in FIG. 5) that aids in establishment of a tight can package as described in further detail below.

Figure 3A:
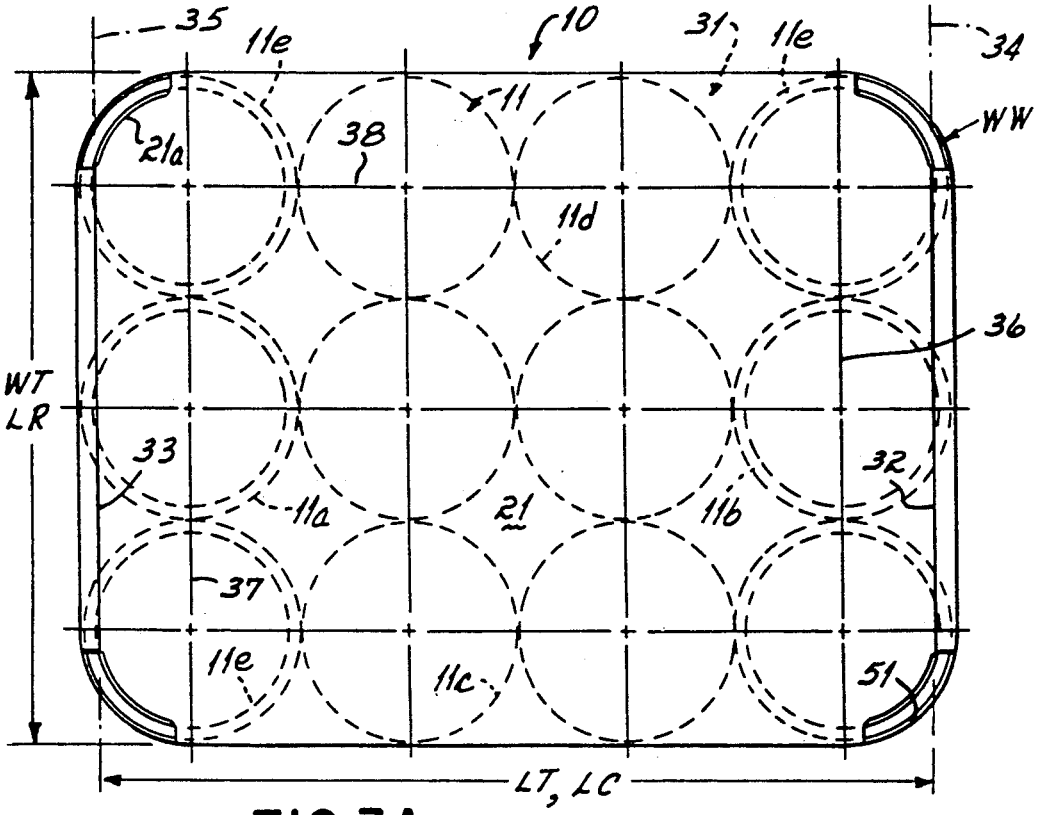
FIGS. 3A and 3B are top and bottom view, respectively, of the carton of FIG. 1.
Figure 3B:
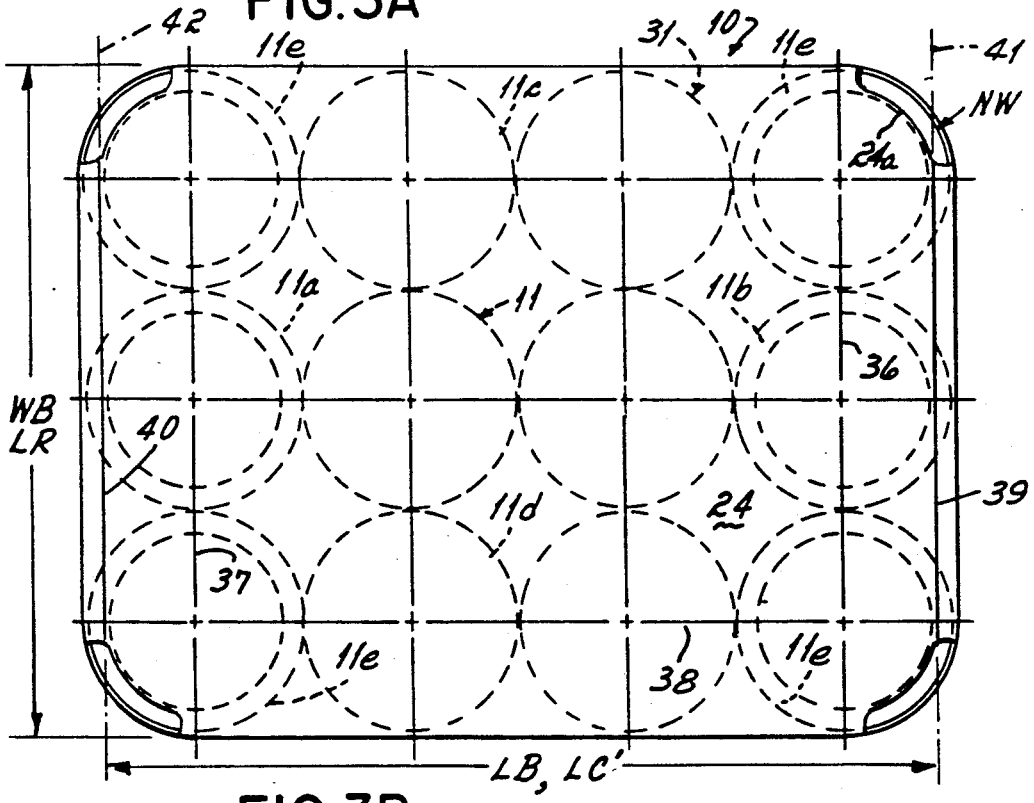
Figure 6:
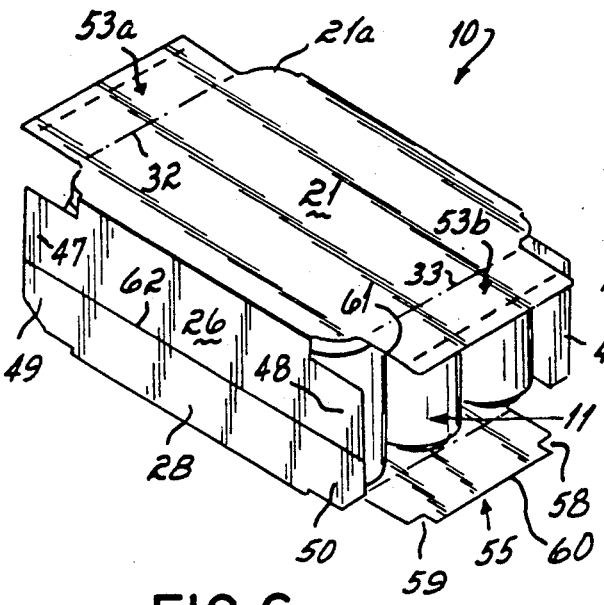
FIG. 6 is a perspective view of an assembled sleeve style closed end can carton with a can matrix installed therein prior to closure of the carton.

The width WT and WB of each of the top 21 and bottom 24 wall panels, respectively, is no less than the length LR of a can row 37 of the can matrix 31 as measured from the outside face to the outside face of the can bodies 13 of those cans 11*c*, 11*d* at opposite ends of the can row when all adjacent cans of the can row are in body contact one with the other. And indeed it is preferable that the width WT, WB of each of the top 21 and bottom 24 walls be slightly greater than the length LR of a can row 37 of that can matrix 31 as measured from the outside face to the outside face of the can bodies 13 in that row simply to allow a slight tolerance for the cans to be soldiered or guided into an erected sleeve style carton as shown in FIG. 6 prior to closure of that carton. Note each of the top 21 and bottom 24 all panels is provided with curved or rounded corner structure 21*a*, 24*a*, respectively. The top wall panel corners 21*a* are configured to overlie but not extend substantially beyond a corner can's head rim 15, and the bottom wall panel's curved corners 24*a* are configured to overlie but not extend substantially beyond a corner can's heel rim 16, when the can carton package 10 is viewed in top plan view. Accordingly, the tapered portions 12*a*, 14*a* of each corner can's head 12 and heel 14 is partially visible when the carton is filled with the can matrix and viewed in top plan view or bottom plan view, respectively, as illustrated in FIGS. 3A and 3B.

Figure 7:
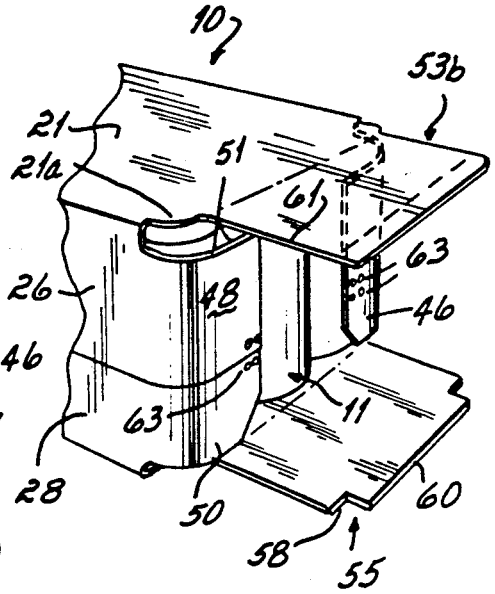
FIG. 7 is a partial perspective view similar to FIG. 6 but illustrating a first closure step of one end of the carton.

Corner flaps 45, 46 are provided integral with each end of full side wall panel 22, those corner flaps extending outwardly beyond the end edges 32, 39 and 33,430 of the top 21 and bottom 24 wall panels, respectively. Also, corner flaps 47, 48 and 49, 50 are provided integral with each partial side wall panel 26, 28, respectively, those corner flaps 47–50 also extending outwardly beyond the end edges 32, 39 and 33, 40 of the top 21 and bottom 24 wall panels, respectively. Note particularly these corner flaps 45–50 are simply integral with the side wall panels 22, 26, 28, respectively, in that they are not separated from those side wall panels by any score line or slit line. Accordingly, and as described in greater detail below, the corner flaps 45-50 can be and are wrapped around the corner cans 11*e* of the can matrix 31 in the final assembled package 10 so as to fit snugly against those corner cans and thereby hold all the cans 11 in a tight matrix configuration. As illustrated by comparison of FIG. 6 with FIG. 7, the length LF of each corner flap 45-50 is such that it does not overlie any can in an end can row 36 or 37 except its own associated corner can 11*e* when the package can matrix is viewed in end view.

Figure 1:
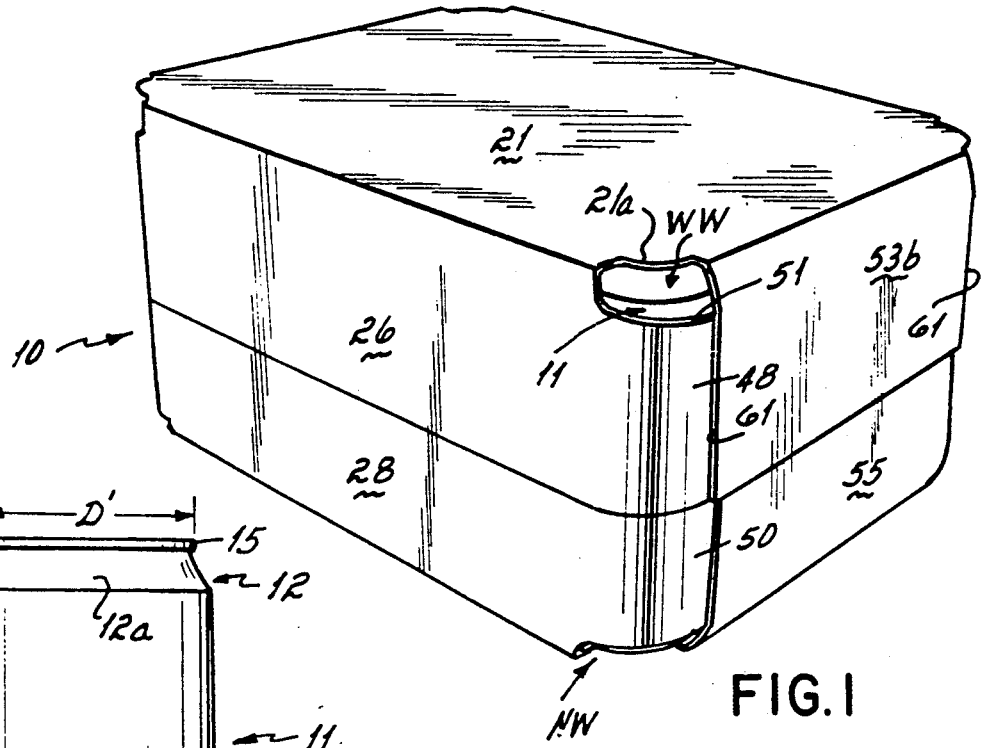
FIG. 1 is a perspective view of a sleeve style closed end can carton in accord with the principles of this invention, same being illustrated in final assembled or package form with a can matrix.
Figure 4A:
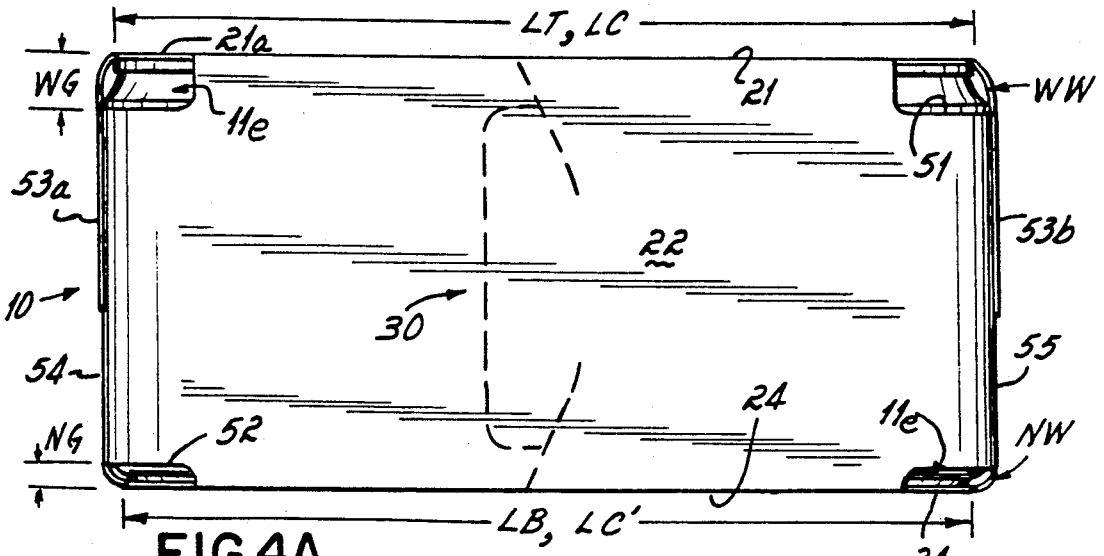
FIGS. 4A and 4B are side and end views, respectively, of the carton of FIG. 1.
Figure 4B:
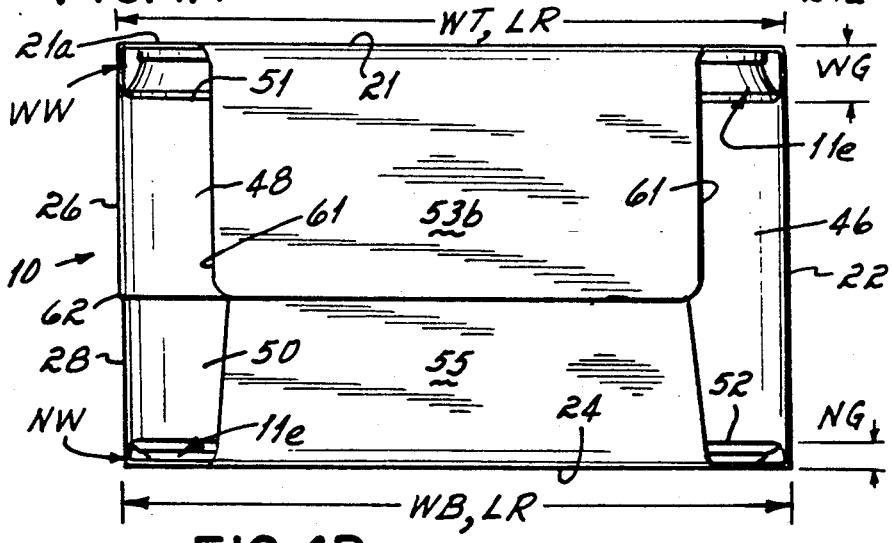

Each corner flap 45, 46, 49, 50 is provided with a top edge 51 that is separated from the top wall 21 by a wide gap WG, and each corner flap 45-48 is provided with a bottom edge 52 that is separated from the bottom wall 24 by a narrow gap NG. This wide gap WG/narrow gap NG structure in the carton blank 20 provides a wide window WW and a narrow window NW at each corner can's shoulder 12 and heel 14, respectively, in the erected corner configuration as illustrated in FIG. 1. Preferably the wide gaps WG are each of a width about equal to the height HD of a can's head 12, and the narrow gaps NG are each of a width about equal to the height HH of a can's heel 14. This wide gap WG/narrow gap NG relationship thereby allows the tapered portions 12*a*, 14*a* of each corner cans' head 12 and heel 14 to be partially visible when the carton is filled with the can matrix 31 and is viewed in side or end elevation view as illustrated in FIGS. 4A and 4B.

The carton blank 20 also includes end flap panels 53*a*, 53*b* that extend outwardly from the scored end edges 32, 33, respectively, of the top wall panel 21, and end flap panels 54, 55 that extend outwardly from the scored end edges 39, 40 of the bottom wall panel 24. These end score lines 32, 33, 39, 40 preferably are enhanced for folding by the inclusion of spaced slits. Each top end flap panel 53*a*, 53*b* is subdivided into an outer fold up glue panel 56 at its outer edge, and an inner locator panel 57. The fold up glue panel 56 is to aid in gluing of the carton together in final closed package 10 form, as described in greater detail below. Each bottom end flap panel 54, 55 is provided with notched out corners 58, 59 at its opposed outer corners to allow the top end flap panels 53*a*, 53*b* to be glued to the corner flaps 45, 46, 49, 50, as well as to the bottom end flap panels 54, 55, as described in greater detail below. Note particularly the bottom end flap panels 54, 55 are tapered from the fold line 39, 40 connection with the bottom wall 24 to the outer edge 60 thereof, same being to ensure the bottom end flap panels are oriented or located within the side edges 61 of the top end flap panels 53*a*, 53*b* when the carton package 10 is glued together in final assembly form.

Use of the sleeve style closed end carton blank 20 of this invention is illustrated in FIGS. 6-9. First, the partial side walls 26, 28 of the carton blank 20 are glued together along glue strip 62. This provides the carton 10 with its sleeve configuration as shown in FIG. 6. And in this sleeve configuration, a series of cans 11 (twelve cans being shown) are inserted in matrix 31 configuration in the sleeved carton as an initial packaging step. Subsequently, the corner flaps 45-50 at each of the carton corners are wrapped around the corner cans 11*e* as shown in FIG. 6. The corner flap pairs 45, 57, 49 and 46, 48, 50 at each end of the carton are pulled tightly toward one another as they are wrapped around the corner cans 11*e*, thereby ensuring that the bodies 13 of the cans 11 within the can matrix 31 are all abutted up against one another, i.e., thereby tightly wrapping the can matrix about the circumference of the matrix, so as to minimize or indeed if not eliminate jostling or movement of the cans within that can matrix in the horizontal plane of that matrix.

Glue dots 63, e.g., hot melt glue, is then applied to the end edges of the corner flaps 45-50 at each end of the partially closed package, the bottom end flaps 54, 55 thereafter being folded up tightly on fold lines 39, 40 into glued relation with the corner flaps. This holds the corner flaps 45-50 in the tightly wrapped relation relative to the can matrix 31. The tight fold up of the bottom end flaps 54, 55 on the bottom wall's end fold lines 39, 40 also holds the can's heels 14 in tight matrix configuration relative one to the other. This intermediate assembly step is illustrated in FIG. 8.

Figure 8:
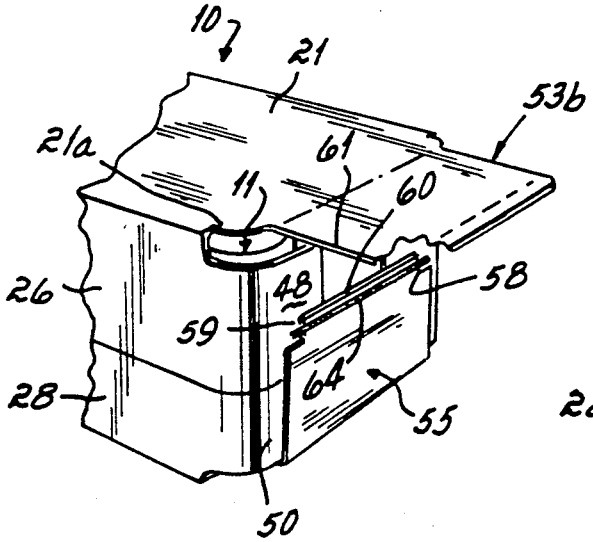
FIG. 8 is a partial perspective view similar to FIG. 7 but illustrating an intermediate closure step of one end of the carton.
Figure 9:
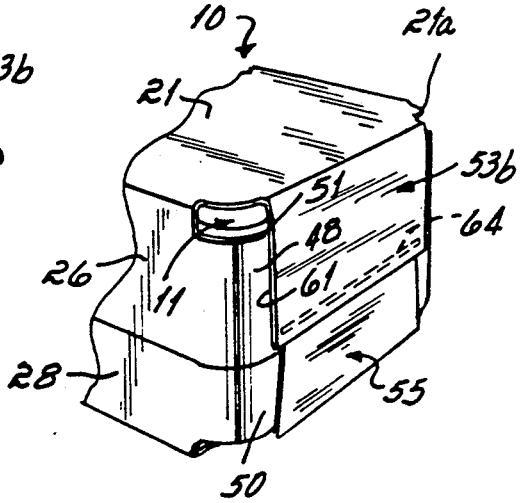
FIG. 9 is a partial perspective similar to FIG. 8 but illustrating final closure of that one end of the can carton.

Thereafter, and as also illustrated in FIG. 8, a glue bead 64, e.g., hot melt glue, is laid down on the exposed end edge portion of each bottom end flaps 54, 55, and also in the area of the associated corner flaps defined by notches 58, 59 in those bottom end flaps 54, 55. The top end flaps 53*a*, 53*b* at each end of the carton are then folded down tightly so that those top end flaps are glued not only to the bottom end flaps 54, 55 but also to the corner flaps 45-50. With both the top 53*a*, 53*b* and bottom 54, 55 end flaps at each end of the carton 10 being tightly folded down relative to the can head rims 15 and can heel rims 16 in the end can rows 37 of the carton, same also contribute to wrap forces in the final can package 10 which holds the cans tightly in the can matrix 31 configuration within the package.

Having described in detail the preferred embodiment of our invention, what we desire to claim and protect by Letters Patent is:

1. A sleeve style closed end carton for a can matrix having a corner can at each corner of said matrix, each corner can having a head, a body, and a heel, each corner can's head and heel having a rim of an outside diameter less than the outside diameter of said body, and each corner can's head and heel including a tapered portion by which said head and heel rims, respectively, are connected with said corner can's body, said carton comprising top, bottom and opposed side walls, said walls being foldably connected one to the other, and each of said walls having opposed ends, curved corner structure defined by each of said top and bottom walls, each top and bottom wall having each corner configured proximately to overlie but not extend substantially beyond a corner can's head and heel rims, respectively, so that said tapered portion of each corner can's head and heel is partially visible when said carton is filled with said can matrix and is viewed in top plan view and bottom plan view, respectively, a corner flap formed integral with each side wall at each end of each side wall, each corner flap being wrapped around a corner can, each corner flap having a top edge spaced from said top wall so as to define an upper gap between said corner flap and said top wall, and also having a bottom edge spaced from said bottom wall so as to define a lower gap between said corner flap and said bottom wall, so that said tapered portion of each corner can's head and heel is partially visible when said carton is filled with said can matrix and is viewed in side or end elevation view, said upper gaps being wider than said lower gaps, and said upper gaps being of a width about equal to the height of a can's head and said lower gaps being of a width about equal to the height of a can's heel, top and bottom end panels foldably connected to opposed ends of said top and bottom walls, respectively, at least one of said top and bottom end panels being connected to said corner flaps at each end of said carton, and said top and bottom end panels being connected to each other at each end of said carton, to effect closure of said carton.

2. A carton as set forth in claim 1, said can matrix having an end can row at each end of said can matrix, each end can row having plural cans each of which presents a head rim with an outer edge, each said top end panel being foldably connected to said to wall along a fold line that substantially overlies a top view phantom tangent line drawn along said outer edges of all cans' head rims in an end can row of said can matrix.

3. A carton as set forth in claim 2, said can matrix having plural can lines with each can line having an end can at each end of said can line, each end can of each can line presenting a head rim with an outer edge, the length of said top wall being about equal to but no less than the length of a can line of said can matrix measured from outer edge to outer edge of the can head rims of those cans at opposite ends of said can line when all adjacent cans of said can line are in body contact one with the other.

4. A carton as set forth in claim 3, each end can row having plural cans each of which presents a heel rim with an outer edge, each said bottom end panel being foldably connected to said bottom wall along a fold line that substantially overlies a bottom view phantom tangent line drawn along said outer edges of all cans' heel rims in an end can row of said can matrix.

5. A carton as set forth in claim 4, the length of said bottom wall being about equal to but no less than the length of a can line of said can matrix measured from outer edge to outer edge of the can head rims of those cans at opposite ends of said can line when all adjacent cans of said can line are in body contact one with the other.

6. A carton as set forth in claim 5, each end can row having said corner cans each of which presents a can body with an outside face, the width of each of said top and bottom walls being no less than the length of an end can row of said can matrix measured from outside face to outside face of the can bodies of those cans at opposite ends of said end can row when all adjacent cans of said end can row are in body contact one with the other.

7. A carton as set forth in claim 6, each end can of each can line presenting a can body with an outside face, the length of each of said top and bottom walls being not as great as the length of a can line of said can matrix measured from outside face to outside face of the can bodies of those cans at opposite ends of said can line when all adjacent cans of said can line are in body contact one with the other.

8. A carton as set forth in claim 1, the length of each corner flap being such that each said corner flap overlaps only that corner can in an end can row associated with said corner flap when said can matrix is viewed in end view.

9. A carton as set forth in claim 1, at least one of said top and bottom end panels at each end of said carton comprising an outer glue panel foldably connected to an inner locator panel, said locator panel being foldably connected to one of said top and bottom walls, said locator panel being folded into closure relation with the other of said top and bottom end panels prior to said glue panel being glued to said other of said top and bottom end panels.

10. A carton as set forth in claim 1, at least one of said top and bottom end panels at each end of said carton comprising a notch at each corner of said one end panel, the other of said top and bottom end panels being glued to both corner flaps through said notches.

11. A carton blank for a sleeve style closed end carton having a corner can at each corner of said matrix, each corner can having a head, a body, and a heel, each corner can's head and heel having a rim of an outside diameter less than the outside diameter of said body, and each corner can's head and heel including a tapered portion by which said head and heel rims, respectively, are connected with said corner can's body, said carton comprising top, bottom and opposed side walls, said walls being foldably connected one to the other, and each of said walls having opposed ends, curved corner structure defined by each of said top and bottom walls, each top and bottom wall having each corner configured proximately to overlie but not extend substantially beyond a corner can's head and heel rims, respectively, so that said tapered portion of each corner can's head and heel is partially visible when a carton erected from said carton blank is filled with said can matrix and is viewed in top plan view and bottom plan view, respectively, a corner flap formed integral with each side wall at each end of each side wall, each corner flap being wrapped around a corner can, each corner flap having a top edge spaced from said top wall so as to define an upper gap between said corner flap and said top wall, and also having a bottom edge spaced from said bottom wall so as to define a lower gap between said corner flap and said bottom wall, so that said tapered portion of each corner can's head and heel is partially visible when a carton erected from said carton blank is filled with said can matrix and is viewed in side or end elevation view, said upper gaps being wider than said lower gaps, and said upper gaps being of a width about equal to the height of a can's head and said lower gaps being of a width about equal to the height of a can's heel, and top and bottom end panels foldably connected to opposed ends of said top and bottom walls, respectively, at least one of said top and bottom end panels being connected to said corner flaps at each end of said carton, and said top and bottom end panels being connected to each other at each end of said carton, to effect closure of said carton.

12. A carton blank as set forth in claim 11, said can matrix having an end can row at each end of said can matrix, each end can row having plural cans each of which present a head rim with an outer edge, each said top end panel being foldably connected to said top wall along a fold line that substantially overlies a top view phantom tangent line drawn along said outer edges of all cans' head rims in an end can row of said can matrix when a carton is erected from said carton blank.

13. A carton blank as set forth in claim 12, said can matrix having plural can lines with each can line having an end can at each end of said can line, each end can of each can line presenting a head rim with an outer edge, the length of said top wall being about equal to but no less than the length of a can line of said can matrix measured from outer edge to outer edge of the can head rims of those cans at opposite ends of said can line when all adjacent cans of said can line are in body contact one with the other in a carton erected from said carton blank.

14. A carton blank as set forth in claim 13, each can row having plural cans each of which present a heel rim with an outer edge, each said bottom end panel being foldably connected to said bottom wall along a fold line that substantially overlies a bottom view phantom tangent line drawn along said outer edges of all cans' heel rims in an end can row of said can matrix in a carton erected from said carton blank.

15. A carton blank as set forth in claim 14, the length of said bottom wall being about equal to but no less than the length of a can line of said can matrix measured from outer edge to outer edge of the can head rims of those cans at opposite ends of said can line when all adjacent cans of said can line are in body contact one with the other in a carton erected from said carton blank.

16. A carton blank as set forth in claim 15, each end can row having said corner cans each of which presents a can body with an outside face, the width of each of said top and bottom walls being no less than the length of an end can row of said can matrix measured from outside face to outside face of the can bodies of those cans at opposite ends of said end can row when all adjacent cans of said end can row are in body contact one with the other in a carton erected from said carton blank.

17. A carton blank as set forth in claim 16, each end can of each can line presenting a can body with an outside face, the length of each of said top and bottom walls being not as great as the length of a can line of said can matrix measured from outside face to outside face of the can bodies of those cans at opposite ends of said can line when all adjacent cans of said can line are in body contact one with the other in a carton erected from said carton blank.

18. A carton blank as set forth in claim 11, the length of each corner flap being such that each said corner flap overlaps only that corner can in an end can row associated with said corner flap when said can matrix is viewed in end view of a carton erected from said carton blank.

19. A carton blank as set forth in claim 11, at least one of said top and bottom end panels at each end of said carton blank comprising an outer glue panel foldably connected to an inner locator panel, said locator panel being foldably connected to one of said top and bottom walls, said locator panel being folded into closure relation with the other of said top and bottom end panels prior to said glue panel being glued to said other of said top and bottom end panels during erecting of a carton from said carton blank.

20. A carton blank as set forth in claim 11, at least one of said top and bottom end panels at each end of said carton blank comprising a notch at each corner of said one end panel, the other of said top and bottom end panels being glued to both corner flaps through said notches in a carton erected from said carton blank.

21. A sleeve style closed end carton for a can matrix having a corner can at each corner of said matrix, each corner can having a head, a body, and a heel, each corner can's head and heel having a rim of an outside diameter less than the outside diameter of said body, each corner can's head and heel having a rim of an outside diameter less than the outside diameter of said body, and each corner can's head and heel including a tapered portion by which said head and heel rims, respectively, are connected with said corner can's body, said carton comprising top, bottom and opposed side walls, aid walls being foldably connected one to the other, and each of said walls having opposed ends, curved corner structure defined by each of said top and bottom walls, each top and bottom wall having each corner configured proximately to overlie but not extend substantially beyond a corner can's head and heel rims, respectively, so that said tapered portion of each corner cans' head and heel is partially visible when said carton is filled with said can matrix and is viewed in top plan view and bottom plan view, respectively, a corner flap formed integral with each side wall at each end of each side wall, each corner flap being wrapped around a corner can, each corner flap having a top edge spaced from said top wall so as to define an upper gap between said corner flap and said top wall, and also having a bottom edge spaced from said bottom wall so as to define a lower gap between said corner flap and said bottom wall, so that said tapered portion of each corner can's head and heel is partially visible when said carton is filled with said can matrix and is viewed in side or end elevation view.

top and bottom end panels foldably connected to opposed ends of said top and bottom walls, respectively, at least one of said top and bottom end panels being connected to said corner flaps at each end of said carton, and said top and bottom end panels being connected to each other at each end of said carton, to effect closure of said carton, and at least one of said top and bottom end panels at each end of said carton comprising an outer glue panel foldably connected to an inner locator panel, said locator panel being foldably connected to one of said top and bottom walls, said locator panel being folded into closure relation with the other of said top and bottom end panels prior to said glue panel being glued to said other of said top and bottom end panels.

22. A carton as set forth in claim 21, said can matrix having an end can row at each end of said can matrix, each end can row having plural cans each of which presents a head rim with an outer edge, each said top end panel being foldably connected to said wall along a fold line that substantially overlies a top view phantom tangent line drawn along said outer edges of all cans' head rims in an end can row of said can matrix.

23. A carton as set forth in claim 22, said can matrix having plural can lines with each can line having an end can at each end of said can line, each end can of each can line presenting a head rim with an outer edge, the length of said top wall being about equal to but no less than the length of a can line of said can matrix measured from outer edge to outer edge of the can head rims of those cans at opposite ends of said can line when all adjacent cans of said can line are in body contact one with the other.

24. A carton as set forth in claim 23, each end can row having plural cans each of which presents a heel rim with an outer edge, each said bottom end panel being foldably connected to said bottom wall along a fold line that substantially overlies a bottom view phantom tangent line drawn along said outer edges of all cans' heel rims in an end can row of said can matrix.

25. A carton as set forth in claim 24, the length of said bottom wall being about equal to but no less than the length of a can line of said can matrix measured from outer edge to outer edge of the can head rims of those cans at opposite ends of said can line when all adjacent cans of said can line are in body contact one with the other.

26. A carton as set forth in claim 25, each end can row having said corner cans each of which presents a can body with an outside face, the width of each of said top and bottom walls being no less than the length of an end can row of said can matrix measured from outside face to outside face of the can bodies of those cans at opposite ends of said end can row when all adjacent cans of said end can row are in body contact one with the other.

27. A carton as set forth in claim 26, each end can of each can line presenting a can body with an outside face, the length of each of said top and bottom walls being not as great as the length of a can line of said can matrix measured from outside face to outside face of the can bodies of those cans at opposite ends of said can line when all adjacent cans of said can line are in body contact one with the other.

28. A carton as set forth in claim 21, said upper gaps being of a width about equal to the height of said corner cans' heads and said lower gaps being of a width about equal to the height of said corner cans' heels.

29. A carton as set forth in claim 21, the length of each corner flap being such that each said corner flap overlaps only that corner can in an end can row associated with said corner flap when said can matrix is viewed in end view.

30. A carton as set forth in claim 21, at least one of said top and bottom end panels at each end of said carton comprising a notch at each corner of said one end panel, the outer of said top and bottom end panels being glued to both corner flaps through said notches.

31. A carton blank for a sleeve style closed end carton having a corner can at each corner of said matrix, each corner can having a head, a body, and a heel, each corner can's head and heel having a rim of an outside diameter less than the outside diameter of said body, and each corner can's head and heel including a tapered portion by which said head and heel rims, respectively, are connected with said corner can's body, said carton comprising top, bottom and opposed side walls, said walls being foldably connected one to the other, and each of said walls having opposed ends, curved corner structure defined by each of said top and bottom walls, each top and bottom wall having each corner configured proximately to overlie but not extend substantially beyond a corner can's head and heel rims, respectively, so that said tapered portion of each corner can's head and heel is partially visible when a carton erected from said carton blank is filled with said can matrix and is viewed in top plan view and bottom plan view, respectively, a corner flap formed integral with each side wall at each end of each side wall, each corner flap being wrapped around a corner can, each corner flap having a top edge spaced from said top wall so as to define an upper gap between said corner flap and said top wall, and also having a bottom edge spaced from said bottom wall so as to define a lower gap between said corner flap and said bottom wall, so that said tapered portion of each corner can's head and heel is partially visible when a carton erected from said carton blank is filled with said can matrix and is viewed in side or end elevation view, and top and bottom end panels foldably connected to opposed ends of said top and bottom walls, respectively, at least one of said top and bottom end panels being connected to said corner flaps at each end of said carton, and said top and bottom end panels being connected to each other at each end of said carton, to effect closure of said carton, and at least one of said top and bottom end panels at each end of said carton blank comprising an outer glue panel foldably connected to an inner locator panel, said locator panel being foldably connected to one of said top and bottom walls, said locator panel being folded into closure relation with the other of said top and bottom end panels prior to said glue panel being glued to said other of said top and bottom end panels during erection of a carton from said carton blank.

32. A carton blank as set forth in claim 31, said can matrix having an end can row at each end of said can matrix, each end can row having plural cans each of which present a head rim with an outer edge, each said top end panel being foldably connected to said top wall along a fold line that substantially overlies a top view phantom tangent line drawn along said outer edges of all cans' head rims in an end can row of said can matrix when a carton is erected from said carton blank.

33. A carton blank as set forth in claim 32, said can matrix having plural can lines with each can line having an end can at each end of said can line, each end can of each can line presenting a head rim with an outer edge, the length of said top wall being about equal to but no less than the length of a can line of said can matrix measured from outer edge to outer edge of the can head rims of those cans at opposite ends of said can line when all adjacent cans of said can line are in body contact one with the other in a carton erected from said carton blank.

34. A carton blank as set forth in claim 33, each can row having plural cans each of which present a heel rim with an outer edge, each said bottom end panel being foldably connected to said bottom wall along a fold line that substantially overlies a bottom view phantom tangent line drawn along said outer edges of all cans' heel rims in an end can row of said can matrix in a carton erected from said carton blank.

35. A carton blank as set forth in claim 34, the length of said bottom wall being about equal to but no less than the length of a can line of said can matrix measured from outer edge to outer edge of the can head rims of those cans at opposite ends of said can line when all adjacent cans of said can line are in body contact one with the other in a carton erected from said carton blank.

36. A carton blank as set forth in claim 35, each end can row having said corner cans each of which presents a can body with an outside face, the width of each of said top and bottom walls being no less than the length of an end can row of said can matrix measured from outside face to outside face of the can bodies of those cans at opposite ends of said end can row when all adjacent cans of said end can row are in body contact one with the other in a carton erected from said carton blank.

37. A carton blank as set forth in claim 36, each end can of each can line presenting a can body with an outside face, the length of each of said top and bottom walls being not as great as the length of a can line of said can matrix measured form outside face to outside face of the can bodies of those cans at opposite ends of said can line when all adjacent cans of said can line are in body contact one with the other in a carton erected from said carton blank.

38. A carton blank as set forth in claim 31, said upper gaps being of a width about equal to the height of said corner cans' heads and said lower gaps being of a width about equal to the height of said corner cans' heels.

39. A carton blank as set forth in claim 31, the length of each corner flap being such that each said corner flap overlaps only that corner can in an end can row associated with said corner flap when said can matrix is viewed in end view of a carton erected from said carton blank.

40. A carton blank as set forth in claim 31, at least one of said top and bottom end panels at each end of said carton blank comprising a notch at each corner of said one end panel, the other of said top and bottom end panels being glued to both corner flaps through said notches in a carton erected from said carton blank.

41. A sleeve style closed end carton for a can matrix where each can of said matrix includes a head, a body, and a heel, each can's head and heel having a rim of an outside diameter less than the outside diameter of said body, and each can's head and heel including a tapered portion by which said head and heel rims, respectively, are connected with said can's body, said can matrix having an end can row at each end of said can matrix with each end can row having plural cans each of which presents a head rim with an outer edge, a heel rim with an outer edge, and a can body with an outside face, said can matrix having plural can lines with each can line having an end can at each end of said can line that is located in said end can row, said carton comprising top, bottom and opposed side walls, said walls being foldably connected one to the other, each of said walls having opposed ends, the length of said top wall being about equal to but no less than the length of a can line of said can matrix measured from outer edge to outer edge of the can head rims of those cans at opposite ends of said can line when all adjacent cans of said can line are in body contact one with the other, the length of said bottom wall being about equal to but no less than the length of a can line of said can matrix measured from outer edge to outer edge of the can head rims of those cans at opposite ends of said can line when all adjacent cans of said can line are in body contact one with the other, the length of each of said top and bottom walls being not as great as the length of a con line of said can matrix measured from outside face to outside face of the can bodies of those cans at opposite ends of said can line when all adjacent cans of said can line are in body contact one with the other, and the width of each of said top and bottom walls being no less than the length of an end can row of said can matrix measured from outside face to outside face of the can bodies of those cans at opposite ends of said end can row when all adjacent cans of said end can row are in body contact one with the other, curved corner structure defined by each of said top and bottom walls, each top and bottom wall having each corner configured proximately to overlie but not extend substantially beyond a corner can's head and heel rims, respectively, so that said tapered portion of each corner can's head and heel is partially visible when said carton is filled with said can matrix and is viewed in top plan view and bottom plan view, respectively, a corner flap formed integral with each side wall at each end of each side wall, each corner flap being wrapped around a corner can, each corner flap having a top edge spaced from said top wall so as to define an upper gap between said corner flap and said top wall, and also having a bottom edge spaced from said bottom wall so as to define a lower gap between said corner flap and said bottom wall, so that said tapered portion of each corner can's head and heel is partially visible when said carton is filled with said can matrix and is viewed in side or end elevation view, top and bottom end panels foldably connected to opposed ends of said top and bottom walls, respectively, at least one of said top and bottom end panels being connected to said corner flaps at each end of said carton, and said top and bottom end panels being connected to each other at each end of said carton, to effect closure of said carton, each said top end panel being foldably connected to said top wall along a fold line that substantially overlies a top view phantom tangent line drawn along said outer edges of all cans' head rims in an end can row of said can matrix, and each said bottom end panel being foldably connected to said bottom wall along a fold line that substantially overlies a bottom view phantom tangent line drawn along said outer edges of all cans' heel rims in an end can row of said can matrix.

42. A carton as set forth in claim 41, said upper gaps being of a width about equal to the height of said corner cans' head and said lower gaps being of a width about equal to the height of said corner cans' heels.

43. A carton as set forth in claim 41, the length of each corner flap being such that each said corner flap overlaps only that corner can in an end can row associated with said corner flap when said can matrix is viewed in end view.

44. A carton as set forth in claim 41, at least one of said top and bottom end panels at each end of said carton comprising an outer glue panel foldably connected to an inner locator panel, said locator panel being foldably connected to one of said top and bottom walls, said locator panel being folded into closure relation with the other of said top and bottom end panels prior to said glue panel being glued to said outer of said top and bottom end panels.

45. A carton as set forth in claim 41, at least one of said top and bottom end panels at each end of said carton comprising a notch at each corner of said one end panel, the other of said top and bottom end panels being glued to both corner flaps through said notches.

46. A carton blank for a sleeve style closed end carton where each can of said matrix includes a head, a body, and a heel, each can's head and heel having a rim of an outside diameter less than the outside diameter of said body, and each can's head and heel including a tapered portion by which said head and heel rims, respectively, are connected with said can's body, said can matrix having an end can row at each end of said can matrix with each end can row having plural cans each of which present a head rim with an outer edge, a heel rim with an outer edge, and a can body with an outside face, said can matrix having plural can lines with each can line having an end can at each end of said can line that is located in said end can row, said carton comprising top, bottom and opposed side walls, said walls being foldably connected one to the other, each of said walls having opposed ends, the length of said top wall being about equal to but no less than the length of a can line of said can matrix measured from outer edge to outer edge of the can head rims of those cans at opposite ends of said can line when all adjacent cans of said can line are in body contact one with the other in a carton erected from said carton blank, the length of said bottom wall being about equal to but no less than the length of a can line of said can matrix measured from outer edge to outer edge of the can head rims of those cans at opposite ends of said can line when all adjacent cans of said can line are in body contact one with the other in a carton erected from said carton blank, the length of each of said top and bottom walls being not as great as the length of a can line of said can matrix measured from outside face to outside face of the can bodies of those cans at opposite ends of said can line when all adjacent cans of said can line are in body contact one with the other in a carton erected from said carton blank, and the width of each of said top and bottom walls being no less than the length of an end can row of said can matrix measured from outside face to outside face of the can bodies of those cans at opposite ends of said end can row when all adjacent cans of said end can row are in body contact one with the other in a carton erected from said carton blank, curved corner structure defined by each of said top and bottom walls, each top and bottom wall having each corner configured proximately to overlie but not extend substantially beyond a corner can's head and heel rims, respectively, so that said tapered portion of each corner can's head and heel is partially visible when a carton erected from said carton blank is filled with said can matrix and is viewed pin to plan view and bottom plan view, respectively, a corner flap formed integral with each side wall at each end of each side wall, each corner flap being wrapped around a corner can, each corner flap having a top edge spaced from said top wall so as to define an upper gap between said corner flap and said top wall, and also having a bottom edge spaced from said bottom wall so as to define a lower gap between said corner flap and said bottom wall, so that said tapered portion of each corner can's head and heel is partially visible when a carton erected from said carton blank is filled with said can matrix and is viewed in side or end elevation view, top and bottom end panels foldably connected to opposed ends of said top and bottom walls, respectively, at least one of said top and bottom end panels being connected to said corner flaps at each end of said carton, and said top and bottom end panels being connected to each other at each end of said carton, to effect closure of said carton, each said top end panel being foldably connected to said top wall along a fold line that substantially overlies a top view phantom tangent line drawn along said outer edges of all cans' head rims in an end can row of said can matrix when a carton is erected from said carton blank, each said bottom end panel being foldably connected to said bottom wall along a fold line that substantially overlies a bottom view phantom tangent line drawn along said outer edges of all cans' heel rims in an end can row of said can matrix in a carton erected from said carton blank.

47. A carton blank as set forth in claim 46, said upper gaps being of a width about equal to the height of said corner cans' heads and said lower gaps being of a width about equal to the height of said corner cans' heels.

48. A carton blank as set forth in claim 46, the length of each corner flap being such that each said corner flap overlaps only that corner can in an end can row associated with said corner flap when said can matrix is viewed in end view of a carton erected from said carton blank.

49. A carton blank as set forth in claim 46, at least one of said top and bottom end panels at each end of said carton blank comprising an outer glue panel foldably connected to an inner locator panel, said locator panel being foldably connected to one of said top and bottom walls, said locator panel being folded into closure relation with the other of said top and bottom end panels prior to said glue panel being glued to said other of said top and bottom end panels during erection of a carton from said carton blank.

50. A carton blank as set forth in claim 46, at least one of said top and bottom end panels at each end of said carton blank comprising a notch at each corner of said one end panel, the other of said top and bottom end panels being glued to both corner flaps through said notches in a carton erected from said carton blank.

* * * * *

UNITED STATES PATENT AND TRADEMARK OFFICE

CERTIFICATE OF CORRECTION

PATENT NO. : 5,197,656

DATED : March 30, 1993

INVENTOR(S) : Norbert Hoell and Charles A. Miller

It is certified that error appears in the above-indentified patent and that said Letters Patent is hereby corrected as shown below:

In Col. 4, line 42, after "can" insert -- 11 --.

In Col. 9, line 60, "erecting" should be -- erection --.

In Col. 10, line 12, "aid" should be -- said --.

In Col. 13, line 68, "con" should be --can--.

In. Col. 14, line 67, "outer" should be -- other --.

Signed and Sealed this

Second Day of August, 1994

*Attest:*

Bruce Lehman

BRUCE LEHMAN

*Attesting Officer*

*Commissioner of Patents and Trademarks*